US005813883A

United States Patent [19]

Lin

[11] Patent Number: 5,813,883

[45] Date of Patent: Sep. 29, 1998

[54] CONNECTOR FOR MICRO CHANNEL PRINTED CIRCUIT BOARD

[76] Inventor: Yu Chuan Lin, No. 28, Wu Chuan 8 Rd., Wu Ku Hsiang, Taipei Hsien, Taiwan

[21] Appl. No.: 712,628

[22] Filed: Sep. 11, 1996

[51] Int. Cl.[6] ..... H01R 23/70

[52] U.S. Cl. ..... 439/637

[58] Field of Search ..... 439/637, 636, 439/60, 62, 108, 924.1, 260, 267, 629, 630, 631, 632, 660, 885, 943

[56] References Cited

U.S. PATENT DOCUMENTS

| | | | |
|---|---|---|---|
| 4,188,715 | 2/1980 | Ammon et al. | 439/943 |
| 4,992,056 | 2/1991 | Douty et al. | 439/872 |
| 5,024,609 | 6/1991 | Piorunneck | 439/637 |
| 5,026,292 | 6/1991 | Pickles et al. | 439/108 |
| 5,051,099 | 9/1991 | Pickles et al. | 439/108 |
| 5,139,446 | 8/1992 | Costello et al. | 439/943 |
| 5,496,180 | 3/1996 | Fabian et al. | 439/60 |
| 5,586,915 | 12/1996 | Baker et al. | 439/924.1 |

*Primary Examiner*—Gary F. Paumen
*Assistant Examiner*—Tho D. Ta
*Attorney, Agent, or Firm*—David & Raymond; Raymond Y. Chan

[57] ABSTRACT

A connector for micro channel printed circuit board comprises a dielectric discloser, numerous conducting plates, a daughter board and a mother board, wherein one or more than one mounting slots is provided for the daughter board, the mounting post corresponding to the mounting slot on the daughter board is provided in the inserting groove of the dielectric enclosure. The coordinated use of the mounting post and mounting slot makes it possible to utilize daughter boards with different geometric ratio multiple spacings, or daughter boards with different lengths and different geometric ratio multiple spacings for the same connector. The internal and external conducting plates may be clipped into each container on the dielectric enclosure, and the corresponding first and second protruding portions of both internal and external conducting plates are installed in the opposite direction with respect to each other for the purpose of guiding and positioning. Moreover, the conducting plates are clipped into the container staggering one spacing with each other. Between each internal and external conducting plate there is an inner wall for isolation and maintaining the unanimity in spacing. Its lower portion, extends out of the dielectric enclosure; its middle portion is clipped firmly into the container; and its upper portion is located in the reliable position of unanimous spacing for inserting and drawing out the daughter board freely.

9 Claims, 18 Drawing Sheets

CONNECTOR FOR MICRO CHANNEL PRINTED CIRCUIT BOARD

FIELD OF THE PRESENT INVENTION

The present invention relates to a connector adapted for incorporating with channel micro printed circuit board.

BACKGROUND OF THE PRESENT INVENTION

The conducting plate for a conventional high density connector can be classified into two types, including a cross sectional side contact type (referring to A type in the following description), and a bent plate contact type (referring to B type in the following description). It is well known to the public that, the conducting plate disclosed in U.S. Pat. No. 5,024,609 is a B type structure, wherein additional element contact separator 22 is employed for keeping the contacts be separated and positioning the gap between the arrayed conducting plates. It increases the production manpower, time, cost, and complication. Numerous adjacent conducting plates can not keep the unanimity of the spacing distances between their centers. The using of geometric ratio multiple for center to center spacing distances between numerous circuit straps (golden fingers) of daughter board causes the difficulty to align the contact center of the conducting plate exactly with the spacing center of circuit strap of the daughter board when said daughter board is connected to the connector.

In view of U.S. Patent No. 5,026,292, both A and B types of conducting plates are employed in the connector, that causes the necessities of making assembling the two types of conducting plates, that would complicate the manufacturing and assembling processes, resulting in wasting too much production manpower, time and cost. Similar disadvantage, that the contact center of the conducting plate is unable to exactly align with the spacing center of the circuit strap of the daughter board, also remains in this prior art.

U.S. Pat. No. 5,051,099 discloses in its principle preferred embodiment that, the A and B type conducting plates disclosed in U.S. Pat. No. 5,026,292 are employed. Therefore, this prior art also has the same disadvantage for the connector as described above.

Although the unanimity of spacing distances for numerous adjacent conducting plates has been considered, the central hollow part of the contact portion of the B type conducting plate would reduce the width of the contact portion of the conducting plate. Moreover, the thickness of another sides of the conducting plates are also reduced in order to keep the unanimity of the spacing distances between the numerous adjacent A type and B type conducting plates. However, even a very small spacing of type central hollow part of the contact portion of the conducting plate may reduce a great amount of its supporting stiffness, that the contact portion of the conducting plate may easily result in deformation or destruction. Further, it is not an ideal configuration of having eccentric supporting strength at the contact portion of the conducting plate.

FIG. 8 of U.S. Pat. No. 5,051,099 illustrates an embodiment of the upper and lower layers of the A type conducting plates wherein the contact portions of the upper and lower layers are eccentrically polished. It is not an ideal structure because the pressed contact portion of the conducting plate would shift to one side due to the non uniform pressing force applied at one side that may result in failing to ensure the center of the conducting plate to receive a force in straight direction.

FIG. 9 of U.S. Pat. No. 5,051,099 shows another preferred embodiment, in which the lower layer of the B type conducting plate's contact portion is formed into a flag shape. To be in coordination with such a shape, the inserting groove of the daughter board shall be enlarged in its upper portion so as to maintain a sufficient space for the flag shaped contact portion to ensure free movement. But an enlarged inserting groove of the daughter board maintains no more enough space for guiding and positioning. This may cause the difficulty for guiding the daughter board into its appropriate place, resulting in deformation or destruction of the upper and lower layers of the conducting plate. Consequently, numerous adjacent conducting plates can not maintain the unanimity of their mutual center to center spacing distances, that the using of geometric ratio multiple center to center spacing distances between numerous circuit straps of the daughter board causes the difficulty to align the contact center of the conducting plate exactly with the spacing center for the circuit straps of the daughter board.

A conventional technique for producing the high density connector has been developed to successfully manufacture the daughter board with geometric ratio multiple spacings and different lengths. Such a connector is disclosed in the U.S. Pat. No. 4,993,972, which described said connector in detail in the specification, in which making the geometric ratio multiple spacings and different lengths for a daughter board for B type conducting plate were realized, but some other appending components are required. That is one of the disadvantages of said invention.

In order to enable a connector having further smaller micro channel (spacing), it almost impossible to resolve the existing problems, such as how to arrange the spacings, how to position the spacing centers, how to secure the conductor plates in their accepting slots, and how to array the conducting plates, etc..

The area of materials required for a side contacting A type conducting plate should be broader than other types of the conducting plate. Thus, design an A type conducting plate, appropriate way of arraying said conducting plate to save the materials is quite necessary.

SUMMARY OF THE PRESENT INVENTION

The main object of the present invention is to provide a connector for micro channel printed circuit board which is able to maintain the unanimity of center to center distances for adjacent conducting plates, and a uniformly distributed straightly directed pressing force on a side cross sectional contact type conducting plate with reliable flexibility.

One subordinate object of the present invention is to provide a connector for micro channel printed circuit board, which can utilize a single connector to achieve the geometric ratio multiple micro spacings and different lengths for a daughter board without other appending components.

One more subordinate object of the present invention is to provide a connector for micro channel printed circuit board in which the daughter board can be positioned to its mounting slot with the assistance of a mounting post for successively positioning the daughter boards of different lengths, different spacings or different geometric ratio spacings with the same connector.

One further subordinate object of the present invention is to provide a connector for micro channel printed circuit board in which the first and second protruding portions on the internal conducting plate and the first and second protruding portions on the external conducting plate are installed reversely for guiding and positioning. The internal and external conducting plates are clipped into the accepting slot with staggering one spacing with each other. The internal and external conducting plates are isolated by an inner wall so that the unanimity of numerous spacings for the internal and external conducting plates can be obtained, so as to enable their lower portions protruding outside the dielectric enclosure, their middle portions securing to both the accepting slot and fixing groove for the accepting slot, and their upper portions fixing at the unanimous position of spacing C for inserting daughter board. Therefore, when drawing out said conducting plate, the operator may maintain said conducting plate's accurate movement with reliable flexibility and with a uniformly distributed straightly directed forces exerted on its center.

Accordingly, a connector for micro channel printed circuit board comprises a dielectric enclosure, conducting plates, a daughter board, and a mother board; wherein at least one mounting slot its provided for the daughter board. In an inserting groove of said dielectric enclosure, there are mounting posts corresponding to mounting slots with one another. Combination of said mounting posts and mounting slots can be used to install a plurality of daughter boards with several different geometric ratio multiple spacings, and for those daughter boards with different lengths and different geometric ration multiple spacings to be applied for the same connector. The internal and external conducting plates can be clipped into each container of the dielectric enclosure. The first and second protruding portions on the external conducting plate are installed reversely for guiding and positioning, and that said two conducting plates are clipped into the container, staggering one spacing with each other. Between each internal and external conducting plates, it is isolated by an inner wall to maintain the unanimity of the spacing. Its lower portion is protruded outside the dielectric enclosure. Its middle portion is secured to the accepting slot. Its upper portion is fixed at the unanimous position of spacing for inserting the daughter board and maintaining said conducting plate's accurate movement with reliable flexibility when it is being drawn out.

BRIEF DESCRIPTION OF THE DRAWINGS

The invention, as well as its many advantages, may be further understood by the following detailed description and drawings.

DETAILED DESCRIPTION OF THE PREFERRED EMBODIMENT

Figure 1:
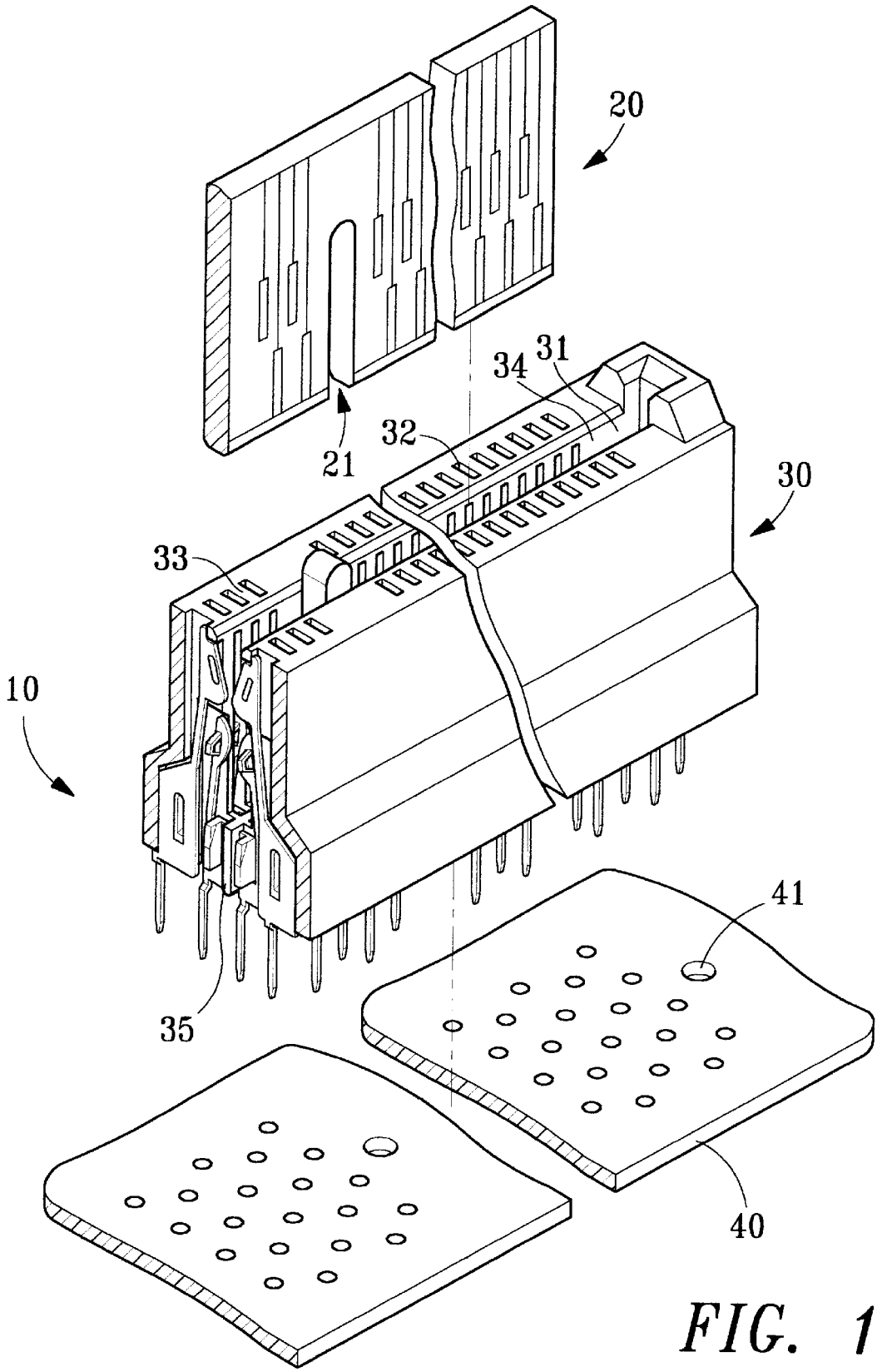
FIG. 1 is a three dimensional perspective view of a first embodiment according to the present invention.
Figure 2:
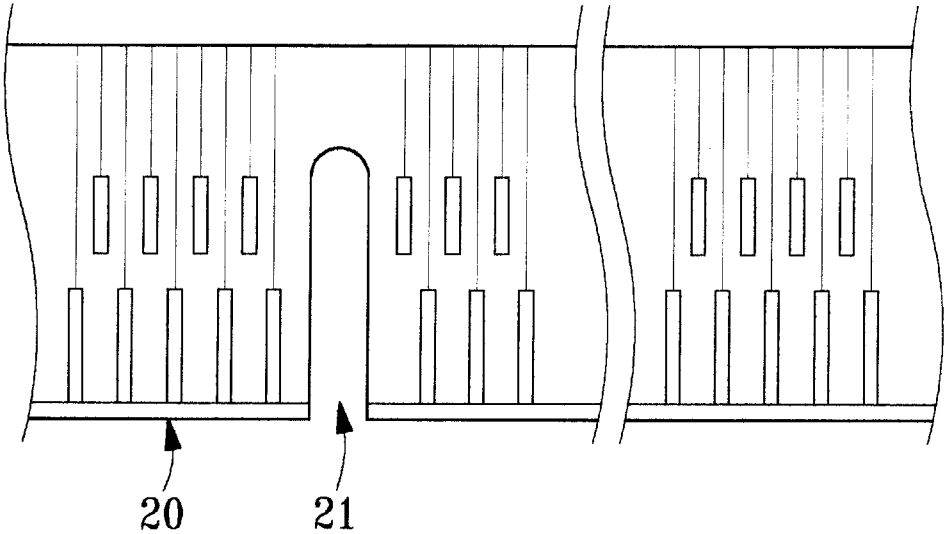
FIG. 2 is a front view of a daughter board.
Figure 3:
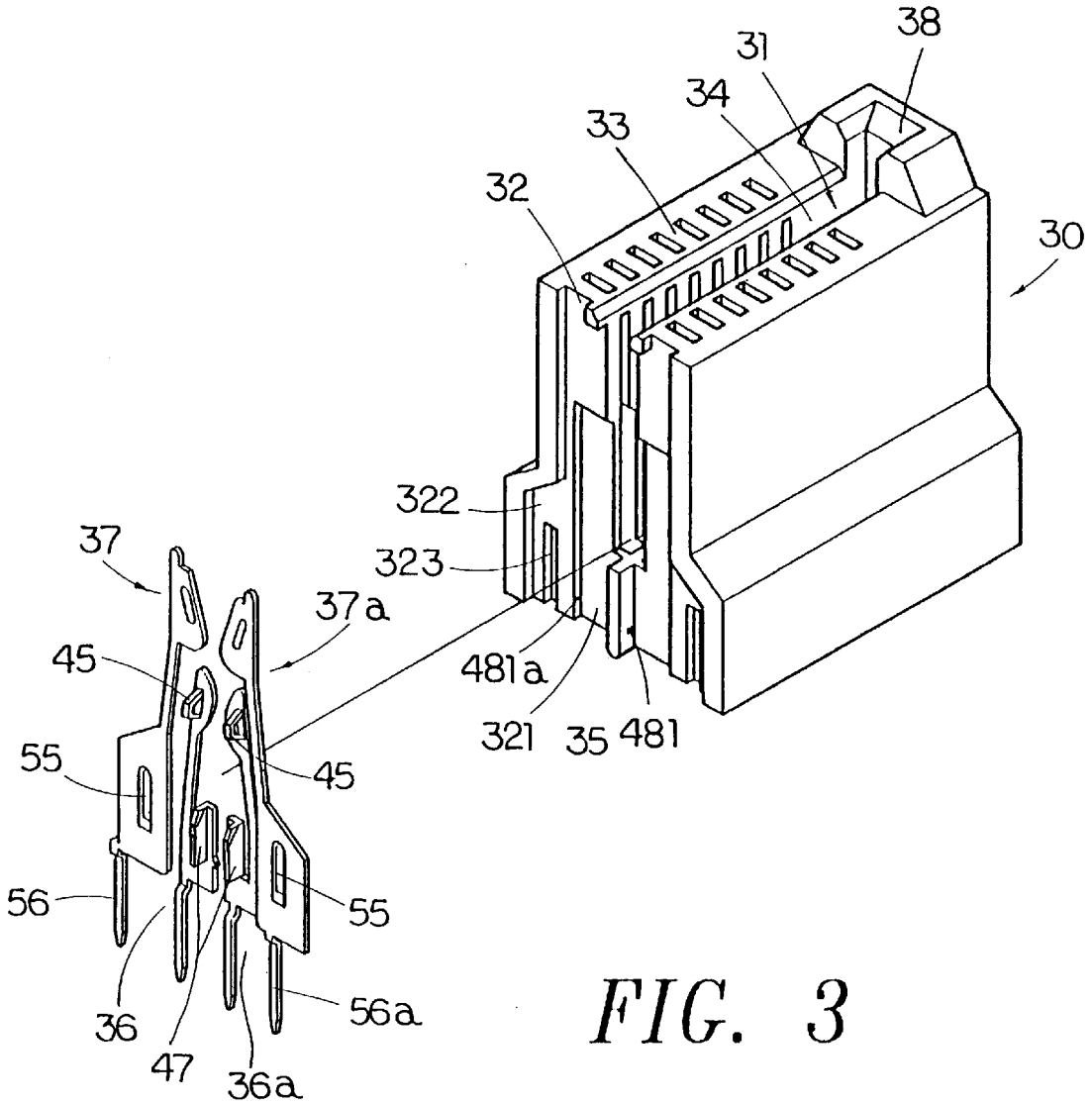
FIG. 3 is a perspective view of the dielectric enclosure and the internal and external conducting plates.
Figure 4B:
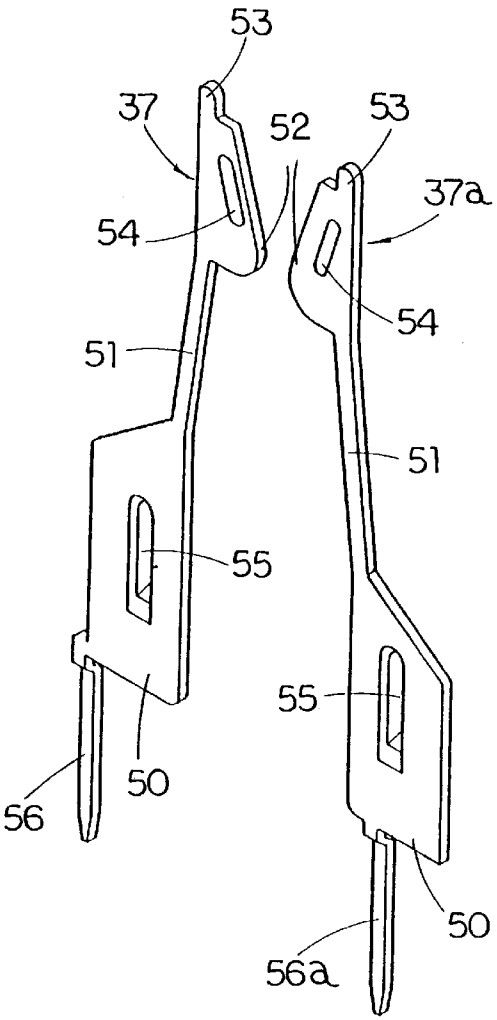
FIG. 4B is a three dimensional view of the external conducting plate.
Figure 4A:
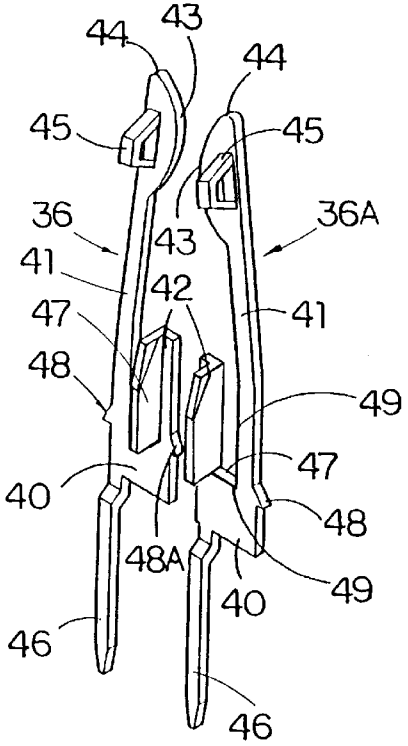
FIG. 4A is a three dimensional view of the internal conducting plate.
Figure 4C:
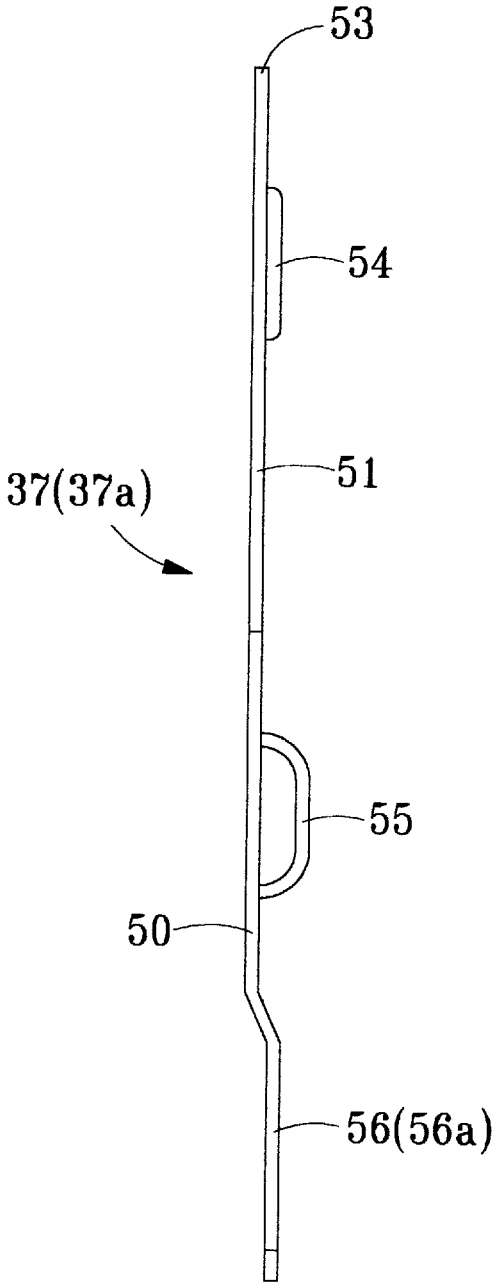
FIG. 4C is a side view of the external conducting plate.
Figure 4D:
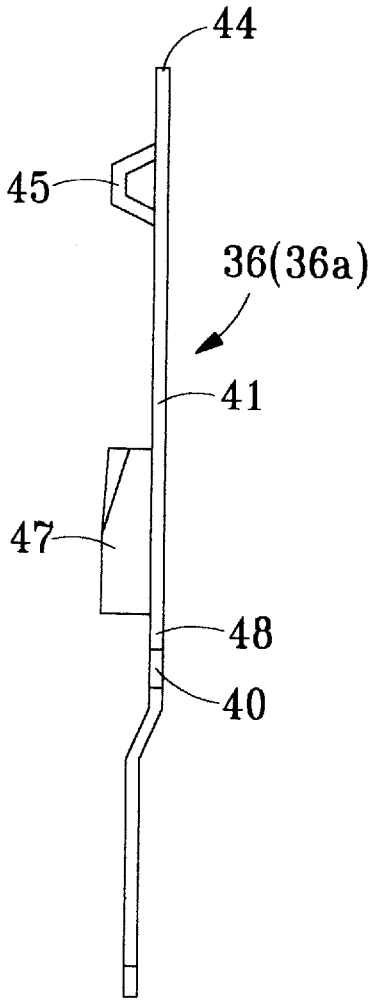
FIG. 4D is a side view of the internal conducting plate.

Referring to FIG. 1, a connector for micro channel printed circuit board 10 comprises a daughter board 20, a dielectric enclosure 30, internal conducting plates 36, 36*a*, external conducting plates 37, 37*a*, and a mother board 40, wherein, referring to FIG. 22, one or more than one mounting slot 21 is provided on the daughter board 20.

Referring to FIGS. 3, 4A, 4D, 6A, and 6B, an inserting groove 31 is formed at a center of the dielectric enclosure 30 for accepting part of the daughter board 20. One or more than one mounting post 39 is provided in the inserting groove 31 at a position corresponding to the mounting slot 21. Multiple number of accepting slots 32 which are isolated by a plurality of inner walls 33 respectively are arranged in array along two sides of the inserting groove 31. A rim 34 of the inner wall 33 is used to divide said inserting groove 31, in which at the bottom of the two opposing rims 34 there is an intermittent post 35 dividing each accepting slot 32 into two sections on two sides respectively.

Each section of each accepting slot 32 includes an internal accepting slot 321, two barriers 481, 481*a* and an external accepting slot 322 which has a fixing groove 323 provided thereon. A width of the accepting slot 32 is more than twice larger than the thickness of the conducting plate 36 so that it is possible to array in staggering a pair of the opposing internal conducting plates 36, 36*a* and a pair of the external conducting plates 37, 37*a* which are all side cross sectional contact type. Said pair of opposing internal conducting plates 36, 36*a* each comprises a base 40, a hanging portion 41 which extends upwards from the base 40, and a corresponding contact part 43 which is adjacent to a free end 44 of the internal conducting plate 36, 36*a*. Moreover, on a plate surface of the contacting part 43, there is a first protruding portion 45 which is protruding forwards. The purpose of providing said first protruding portion is that, the internal conducting plates 36, 36*a*, which are settled in the accepting slot 32 with the width more than twice larger than the thickness of said plates, may allow their free movement by said first protruding portion 45 within a fixed range of spacing C, for assuring not to escape off side from the spacing C.

Each of the internal conducting plates 36, 36*a* further comprises a welded foot 46 extended downwardly from the other end of the internal conducting plate 36, 36*a* to the bottom of the dielectric enclosure 30. A slot gap 49 cut in L-shape is provided between said protruding portion 42 and the hanging beam 41, that the cut portion is folded forwards to form a second protruding portion 47 with inclined arc shape. The purpose of the protruding portion 47 is to provide the corresponding internal conducting plate 36, 36*a* with a sufficient range for movement and also to secure said internal conducting plates 36, 36*a* firmly to it. Two sharp protrusions 48, 48*a* are provided on each end of the hanging beam 41 and the protruding portion 42 respectively. When a pair of opposing internal conducting plates 36, 36*a* are clipped into the internal accepting slot 321, said two first protruding portions 42 will immediately contact with an inner wall surface of the internal accepting slot 321. At the same time, the intermittent post 35 recesses between the two protruding portions 42, and the two second protruding portions 47 and the protrusions 48, 48*a* are clipped to the barriers 481, 481*a*. In this way, the internal conducting plates 36, 36*a* are firmly positioned and clipped from all directions to the internal accepting slot 321 which width is several times larger than the thickness of said internal conducting plates 36, 36*a*.

The opposing pair of the external conducting plates 37, 37*a* each comprises a base 50, and a hanging beam 51 extending upwards from the base 50 which has a contact part 52 positioned adjacent to a free end 53 of each external conducting plate 37, 37*a*. Moreover, on the surface of said contact part 52, there is a first protruding portion 54 protruding backwards. A top width of the external accepting slot 322 may be enlarged to more than two times of the thickness of the external conducting plate 37, 37*a*, so that the element for ejection mold may be made large enough to maintain sufficient strength and retain the unanimity of a spacing between the external conducting plates 37, 37*a*. On the surface of the base 50, there is a second protruding portion 55 protruding backwards by punching, so that a middle part of the external conducting plates 37, 37*a* has only two L-shaped surfaces which can be tightly clipped to the respective external accepting slot 322 which width is several times larger than the thickness of said external conducting plate 37, 37*a*. Moreover, a welded foot 56, 56*a* is extended downwardly from the other end of each external conducting plate 37, 37*a* to the bottom of the dielectric enclosure 30.

Figure 5B:
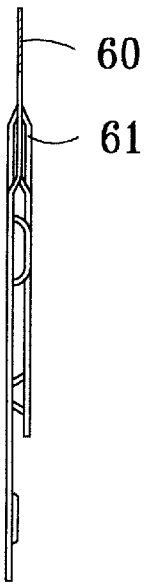
FIG. 5B is a A—A cross sectional view showing the internal and external conducting plates connected in array.
Figure 5A:
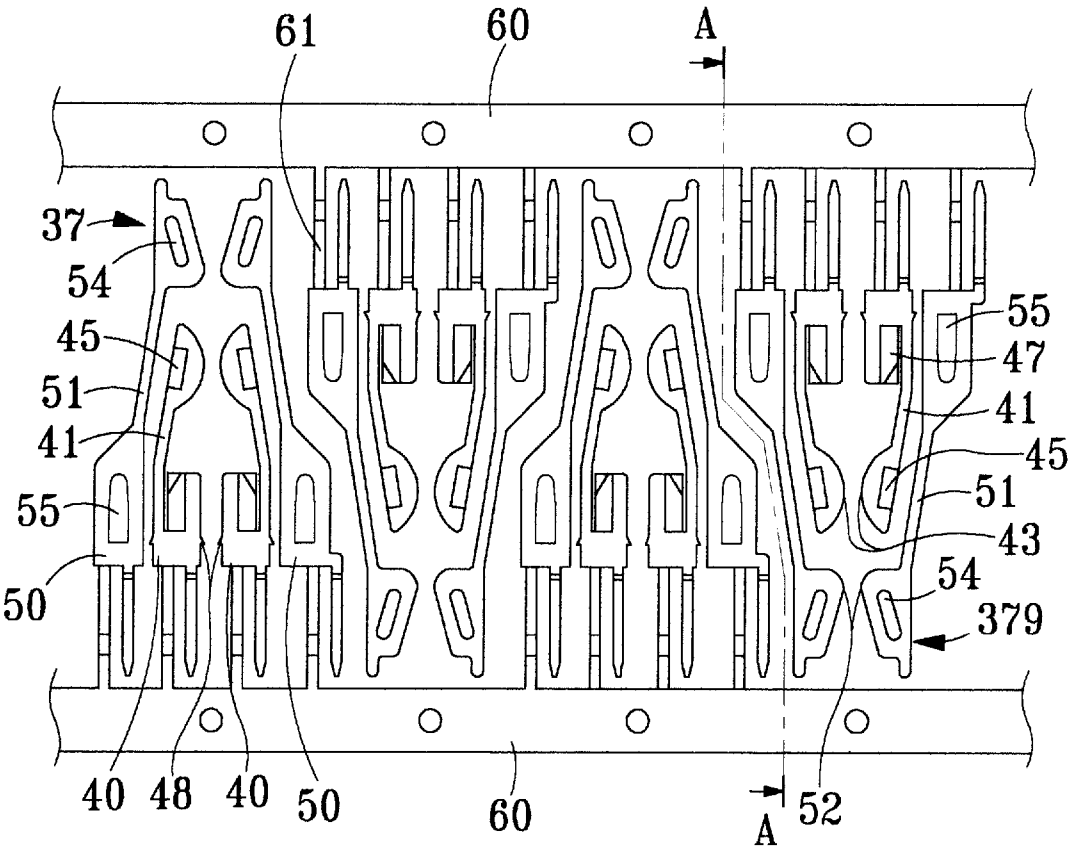
FIG. 5A is a schematic side view showing the internal and external conducting plates concerted in array.
Figure 6A:
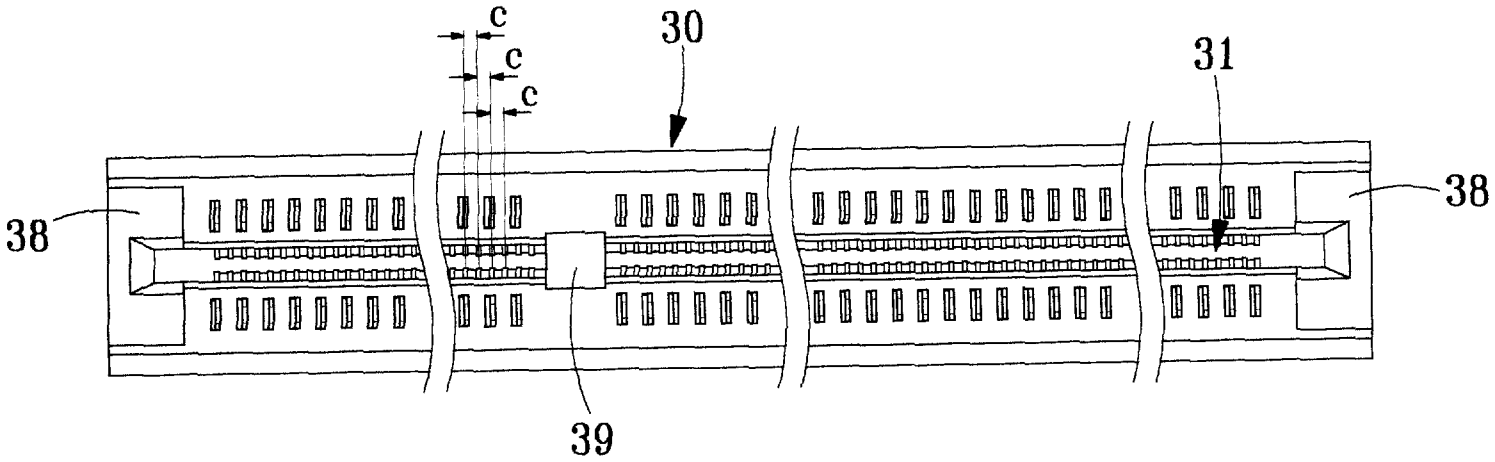
FIG. 6A is a top view of the connector according to the present invention.
Figure 6B:
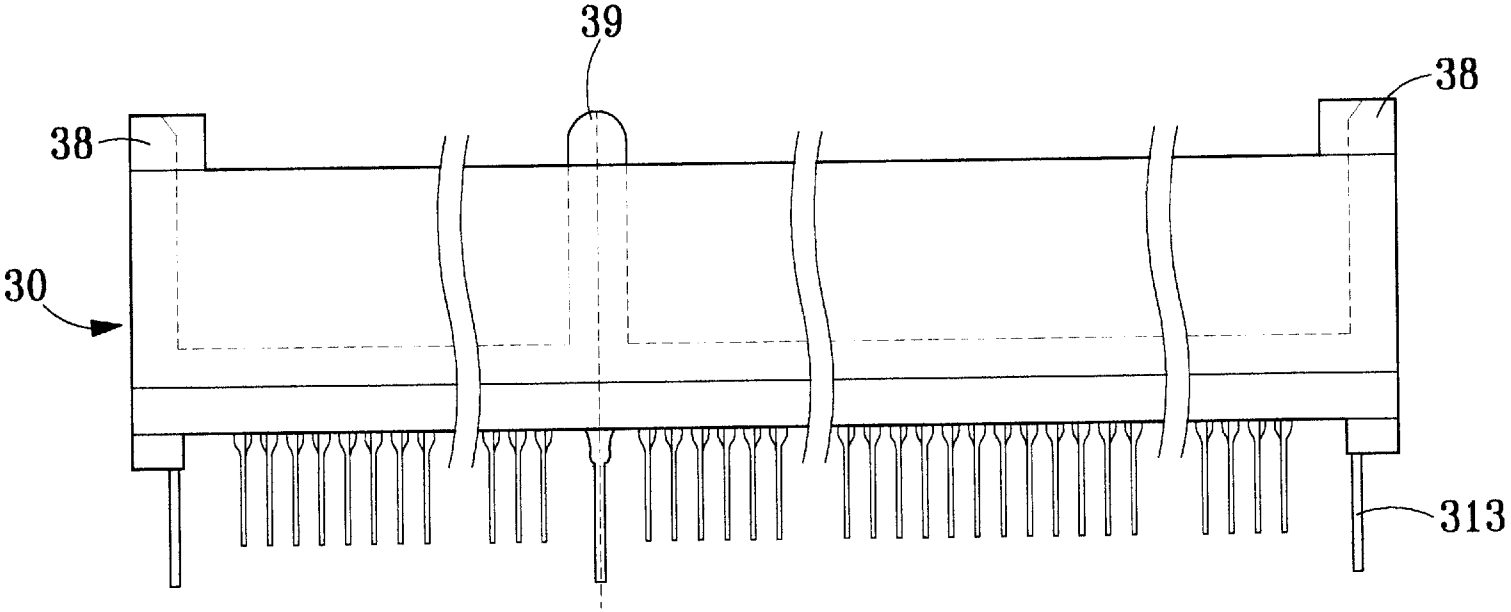
FIG. 6B is a front view of the connector according to the present invention.
Figure 6C:
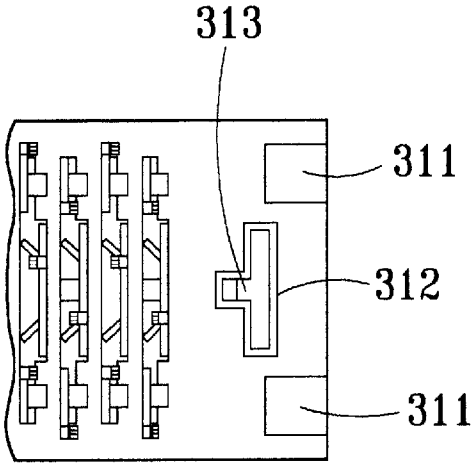
FIG. 6C is a bottom view of the connector according to the present invention.
Figure 6D:
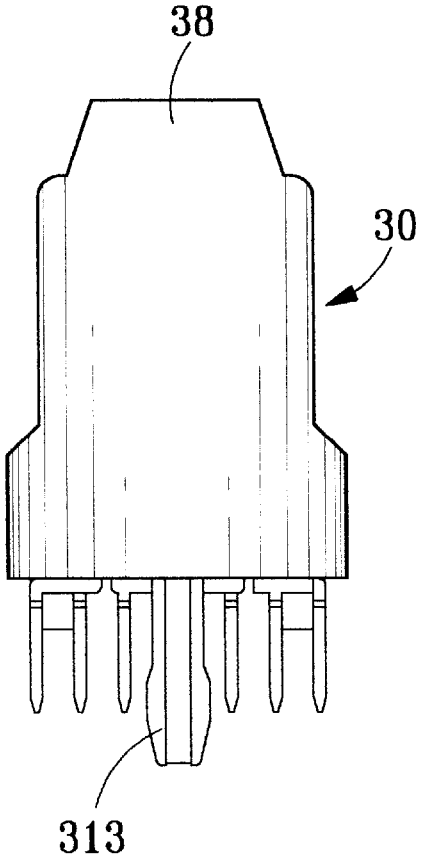
FIG. 6D is a right side view of the connector according to the present invention.
Figure 7:
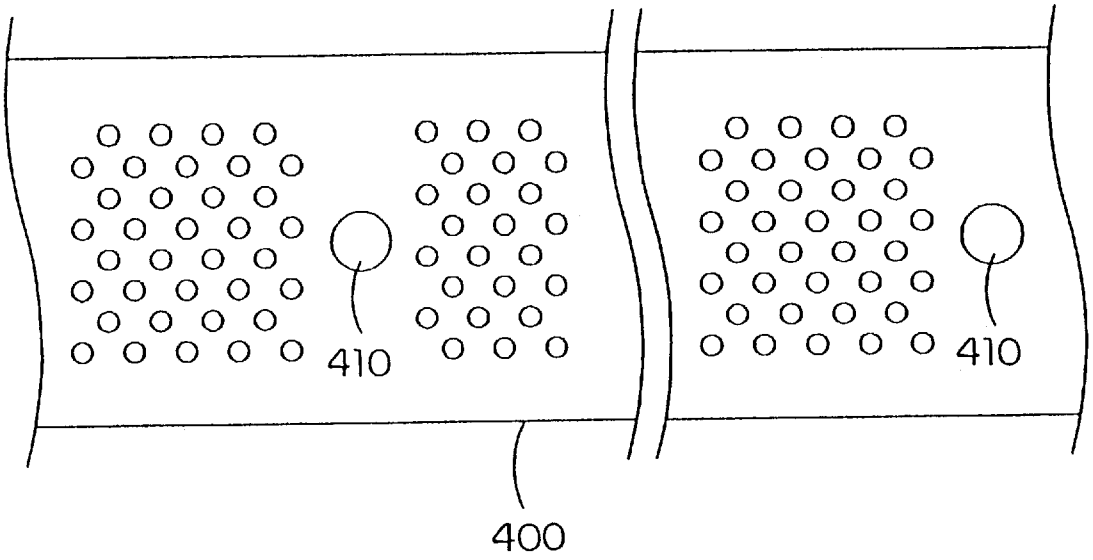
FIG. 7 is a top view of the mother plate.

Referring to FIGS. 1, 5A and 5B, those internal conducting plates 36, 36*a* and external conducting plates 37, 37*a* are made by punching reversely arrayed face to face and connected with two material tapes 60 and connecting strips 61. The internal and external conducting plates 36, 36*a*, 37, 37*a* are reversely bent to make a spacing staggering therebetween, so that the material tapes 60 and the connecting strips 61 will be more convenient for further treatment. The first and second protruding portions 45, 47 on the internal conducting plates 36, 36*a* and the first and second protruding portions 54, 55 on the external conducting plates 37, 37*a* are formed by punching process in the reverse direction with each other to obtain the purpose for guiding and positioning, and to clip into the accepting slot 32 in the way staggering each other with a spacing C. The pair of the internal conducting plates 36, 36*a* and the pair of the external conducting plates 37, 37*a* are isolated by the inner wall 33, that the purpose for retaining the unanimity of spacings C among numerous internal and external conducting plates 36, 36*a*, 37, 37*a* can be realized. The middle parts of the internal and external conducting plates 36, 36*a*, 37, 37*a* are firmly secured to the lower section of the accepting slot 32 which width is several times larger than the thickness of said internal and external conducting plates 36, 36*a*, 37, 37*a*. Upper portions of the internal and external conducting plates 36, 36*a*, 37, 37*a* provide the unanimous spacing C for inserting the daughter board 20, so that when it is being drawn out, a uniformly distributed force will exert on the center line of the internal and external conducting plates 36, 36*a*, 37, 37*a*.

Inserting face to face and arraying the internal conducting plates 36, 36*a* and the external conducting plates 37, 37*a* are accomplished simultaneously so as to lead to the saving of materials, manpower and cost. When assembling a connector 10, the internal and external conducting plates 36, 36*a*, 37, 37*a* may be installed in the accepting slot 32 of the dielectric enclosure 30 and numerous dielectric enclosure 30 are arrayed at the same time. Such speedy work process as to assemble numerous internal and external conducting plates 36, 36*a*, 37, 37*a* simultaneously is quite remarkable in saving production time, manpower and reducing the cost.

Referring tot FIGS. 2, 6A to 6D, and 7, a guide wall 38 extending upwards from front and rear upper ends of the dielectric enclosure 30 is provided, which is used to guide the daughter board 20 into the inserting groove 31. As mentioned above, the mounting post 39 corresponding to the mounting slot 21 of the daughter board 20 is provided in the inserting groove 31. It will be preferable to prepare one or more than one mounting slot 21 with respective mounting post 39 for the daughter board 20. The mounting post 39 cooperated with the mounting slot 21 with several different depths can be used to match several kinds of daughter boards 20 with different geometric ratio multiple spacing to decrease the degree of electric interference. More than one mounting posts 39 incorporated with the mounting slot 21 of the daughter board for positioning advantageously results in possibility of applying the daughter boards 20 of different lengths and different geometric ratio multiple spacings in the same connector 10, that simplifies the types and specifications of the connectors 10 and decreases the amount of stock greatly contributing to the manufacturer. At the bottom surface of the dielectric enclosure 30, a holder mole 312 is provided on which a holder 313 may be attached. The holder 313 is to be inserted into the guiding hole 410 formed on the mother board 40 so that the connector 10 may be accurately guided to clip into the corresponding position on mother board 40. It is preferable that each connector 10 has more than two holders 313.

Figure 8:
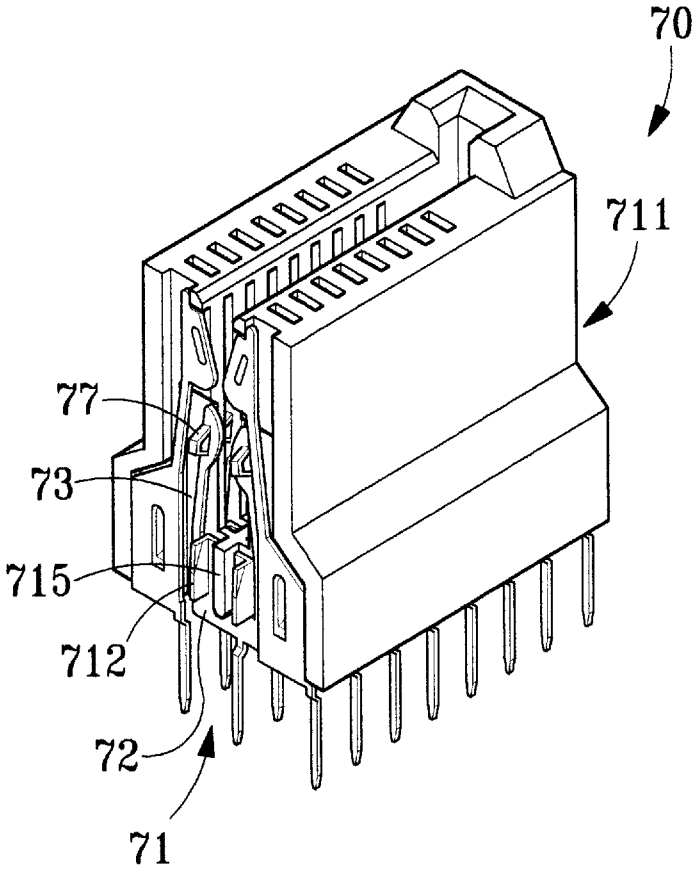
FIG. 8 is a three dimensional view showing the dielectric enclosure with the assembly of the internal and external conducting plates of the second embodiment according to the present invention.
Figure 9:
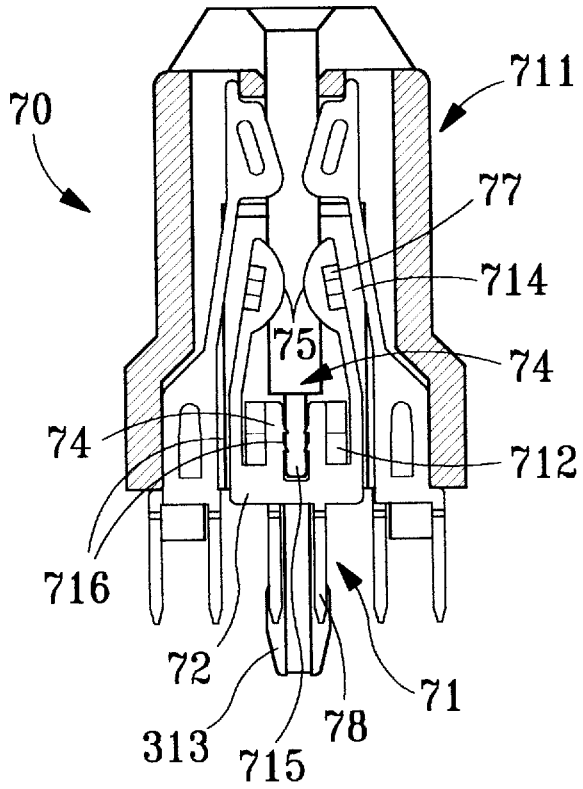
FIG. 9 is a cross sectional view of a second embodiment according to the present invention.
Figure 10:
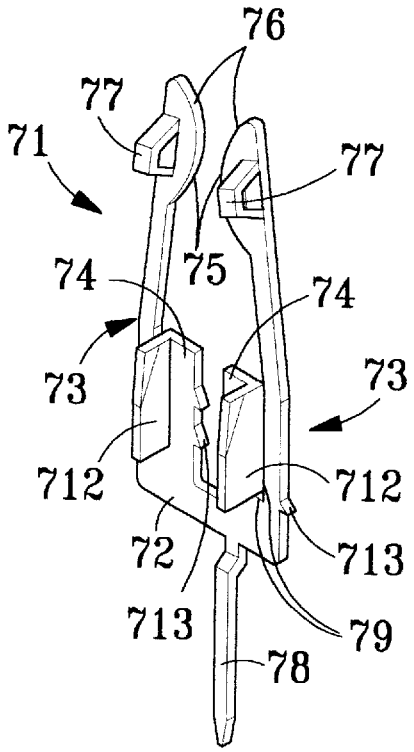
FIG. 10 is a three dimensional perspective view of the internal conducting plate of the second embodiment according to the present invention.

Referring to FIGS. 8, 9 and 10, this is a second embodiment of a connector for micro channel printed circuit board 70 with different variation of its channel, according to the present invention. Its main structure is essentially identical with that in the first embodiment. The only difference between the first and second embodiments is that, in the second embodiment, a middle of a bottom of its internal conducting plate 71 is connected together to form a single body configuration, wherein the internal conducting plate 771 includes a base 72, in which two cantilever beams 73 extending upwards from its two sides and two protruding portions 74 protruding upwards from their middle portion. A corresponding contact part 775 is adjacent to a free end 76 each cantilever beam 73 of the internal conducting plate 71. A first protruding portion 77 which protruding forwards is provided on the surface of each contact part 75 for allowing the internal conducting plate 71 to be able to move within a fixed range of spacing C for assuring not to escape offside from the spacing C.

The internal conducting plate 71 merely comprises one welded foot 78 which is extended downwardly from the base 72 of said internal conducting plate 71 downwardly to the bottom of a dielectric enclosure 711. A slot gap 79 cut in L shape is provided between the protruding portion 74 and the cantilever beam 73. The cut portion is folded forwards to form a second protruding portion 712 with inclined arc shape. The purpose of the second protruding portion 712 is to provide the internal conducting plate 71 with a sufficient range for movement. A sharp protrusion 713 is provided for each end surface of the cantilever beam 73 and the protruding portion 74 respectively. When the internal conducting plate 71 is clipped into an internal accepting slot 714, the first protruding portion 77 will immediately contact with an inner wall surface of the internal accepting slot 714. At the same time, an isolating wall 716 recesses between the two protruding portions 713 which are clipped to the slot gap. In this way, the internal conducting plate 71 is firmly positioned to the internal accepting slot 714. The single welded foot of the internal conducting plate 71 provides an alternative path if necessary.

Figure 11:
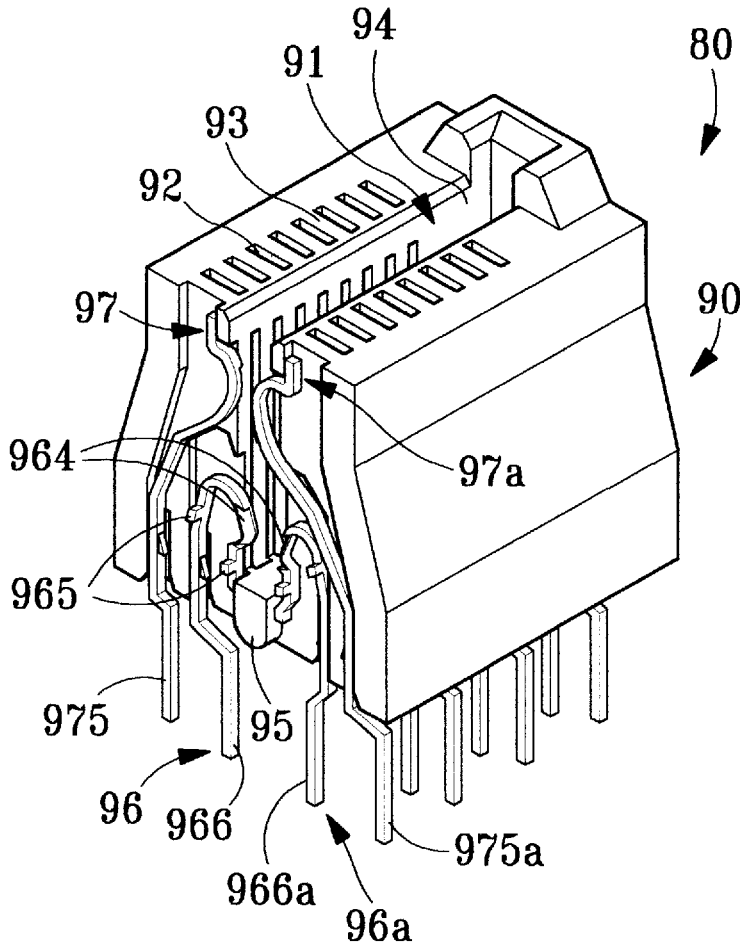
FIG. 11 is a three dimensional perspective view of a third embodiment according to the present invention, showing the dielectric enclosure with the internal and external conducting plate's assembly.
Figure 11A:
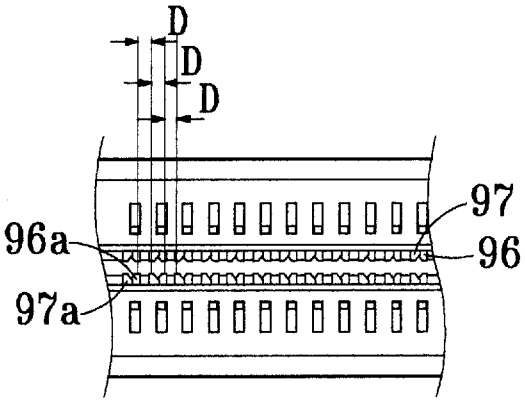
FIG. 11A is a top view of the third embodiment according to the present invention.
Figure 12:
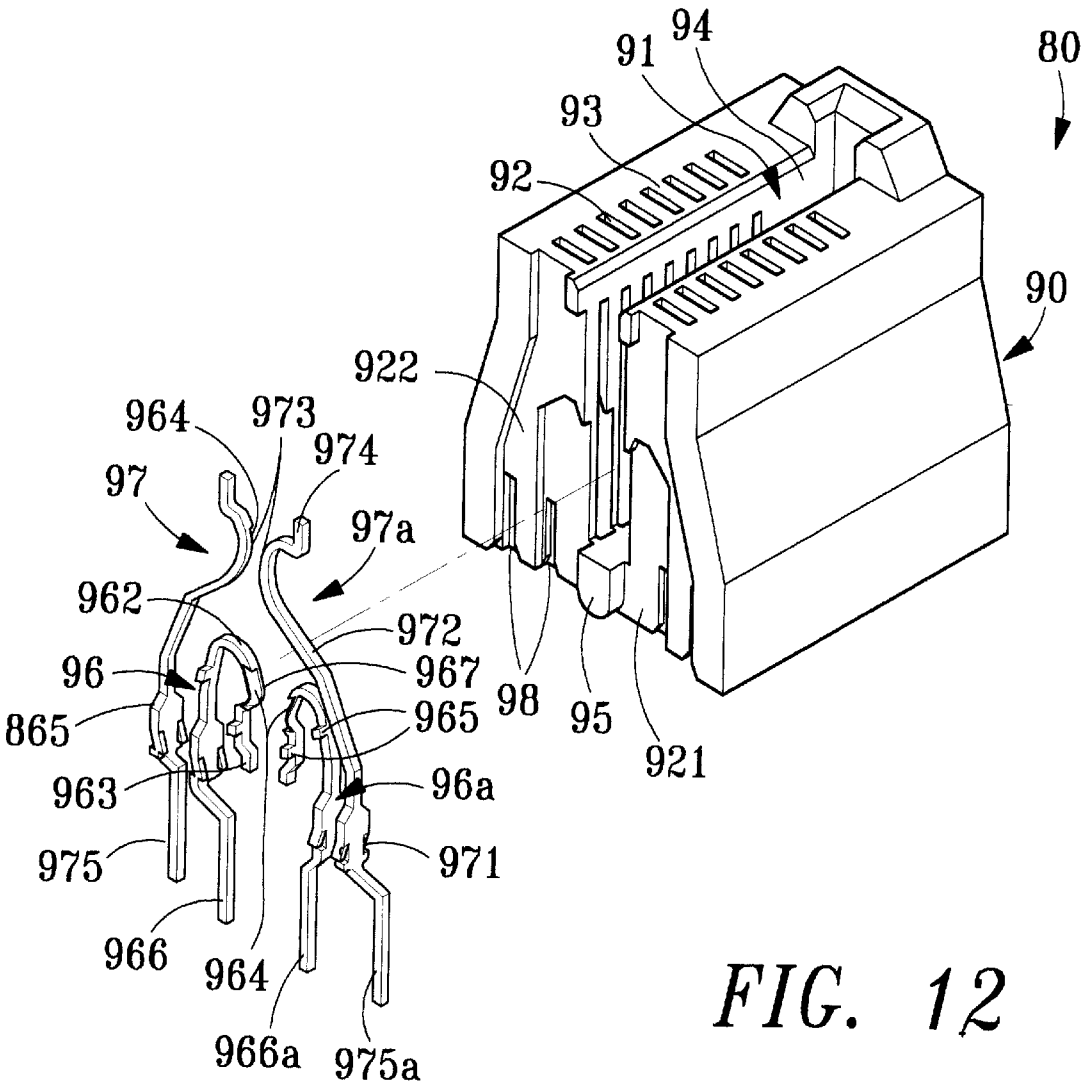
FIG. 12 is a perspective view of the third embodiment according to the present invention.
Figure 13:
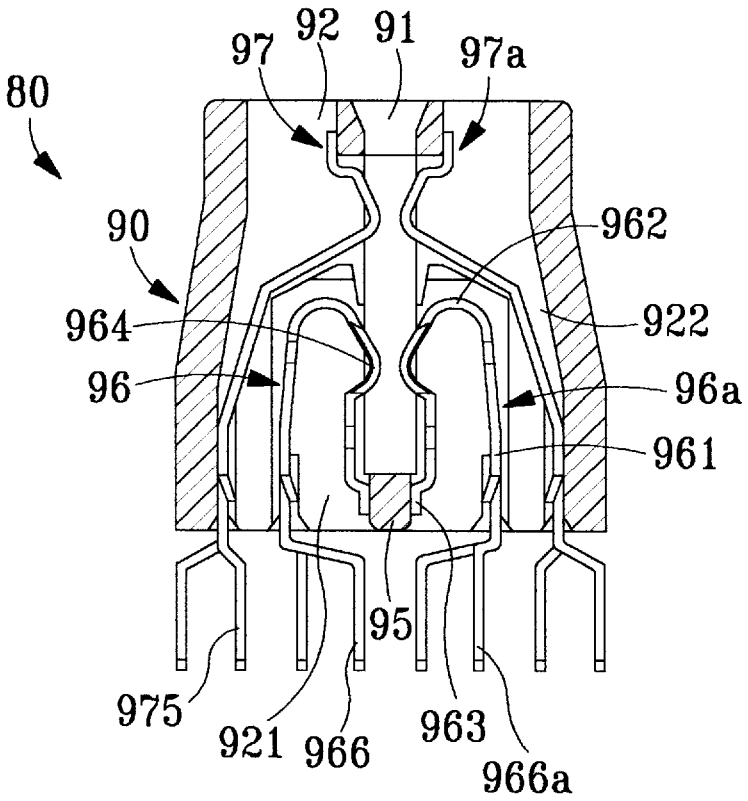
FIG. 13 is a cross sectional view of the third embodiment according to the present invention.

Referring to FIG. 11, this is a third embodiment of a connector for micro channel printed circuit board 80 according to the present invention, wherein the conducting plate is of bent plate contact type.

Referring to FIGS. 11, 11A, 12, and 13, an inserting groove 91 is provided at the center of a dielectric enclosure 90 for accepting part of the daughter board. Numerous accepting slots 92 are in array at both sides of the inserting groove 91. Each accepting slot 92 is isolated by an inner wall 93 and outside of which a mounting slot 98 for conducting plate is provided. A rim 94 of the inner wall 93 is used to divide the inserting groove 91. At the bottom of the opposing rims 94, an intermittent post 95 is provided for separating them. An internal accepting slot 921 and an external accepting slot 922 of the accepting slot 92 are provided. The mounting slots 98 are provided for each the accepting slot 92 for arranging a pair of the opposing internal conducting plates 96, 96*a* and a pair of the external conducting plates 97, 97*a*. Each internal conducting plate 96, 96*a* comprises a hanging beam 961, a bent part 962 extending upwards from the hanging beam 961 and a supporting part 963 extending downwards from the hanging beam 961. A corresponding contact part 967 is formed adjacent too the bent part 962 of each of the internal conducting plates 96, 96*a*. Part of the contacting plates 97, 97*a* are formed into a tilted thin plate 964 through continuous pressing and forging. The internal and external conducting plates 96, 96*a*, 97, 97*a* are also pressed in reverse direction with one another to form the tilted thin plates 964, so that the unanimity of spacings D among numerous adjacent internal and external conducting plates 96, 96*a*, 97, 97*a* can be maintained. The density and elasticity of the tilted thin plates 964 are so high that tightness of eccentric contact between the internal and external conducting plates 96, 96*a*, 97, 97*a* may be obtained to improve the quality of contact. Jutting ears 965 are provided between the hanging beam 961 and the supporting part 963 of the internal conducting plates 96, 96*a* so as to hold the internal conducting plates 96, 96*a* at their exact place stably and to maintain the spacings D unanimous with respect to the external conducting plates 97, 97*a* which is convenient for free moving and not to escape from the spacing D. Each internal conducting plate 96, 96*a* further comprises welded foot 966, 966*a* extended downwardly from other ends of the internal conducting plates 96, 96*a* to the bottom of the dielectric enclosure 90.

Each of the opposing external conducting plates 97, 97*a* comprises a hanging beam 971 and a tilted part 972 which is extended upwards from the hanging beam 971. A corresponding contact part 973 is formed adjacent to a free end 974 of each of the contacting plates 97, 97*a* which also comprises welded foot 975, 975*a* extending from other ends of the external conducting plates 97, 97*a* to the bottom of the dielectric enclosure 90.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A connector for micro channel printed circuit board, comprising a daughter board, a dielectric enclosure, at least a pair of opposing internal conducting plates, at least a pair of opposing external conducting plates, and a mother board;

at least a mounting slot being provided on the daughter board, an inserting groove being formed at a center of the dielectric enclosure for accepting part of the daughter board, at least a mounting post being provided in the inserting groove at a position corresponding to the mounting slot, a plurality of accepting slots which are isolated by a plurality of inner walls respectively being arranged in array along two sides of the inserting groove, a rim of each of the inner walls being used to divide the inserting groove, in which at a bottom of each of the opposing rims there is an intermittent post dividing each the accepting slot into two sections on two sides respectively, each of the sections of each the accepting slot including an internal accepting slot, two barriers and an external accepting slot which has a fixing groove provided thereon, wherein a width of the accepting slot is more than twice larger than a thickness of the conducting plate, so that it is possible to array in staggering the pair of internal conducting plates and the pair of the external conducting plates which are all side cross sectional contact type;

the pair of internal conducting plates each comprising a base, a hanging portion which extends upwards from the base, and a corresponding contact part which is positioned adjacent to a free end of each the internal conducting plate, and that on a plate surface of the contacting part, there is a first protruding portion which is protruding forwards, so that the internal conducting plates, which are settled in the accepting slot, allowing a free movement thereof by the first protruding portion within a fixed range of spacing for assuring not to escape off side from the spacing, each of the internal conducting plates further comprising a welded foot extended downwardly from another end of the internal conducting plate to a bottom of the dielectric enclosure, a slot gap cut in L-shape being provided between the protruding portion and the hanging beam, that the cut portion is folded forwards to form a second protruding portion with an inclined arc shape, so that the corresponding internal conducting plate is provided with a sufficient range for movement and the internal conducting plates is secured firmly thereto, two sharp protrusions being provided on each end of the hanging beam and the protruding portion respectively, therefore when the pair of opposing internal conducting plates are clipped into the respective internal accepting slot, the two first protruding portions immediately contact with an inner wall surface of the internal accepting slot, at the same time, the intermittent post recessing between the two protruding portions, and that the two second protruding portions and the protrusions are clipped to the barriers, so that, the internal conducting plates are firmly positioned and clipped from all directions to the internal accepting slot;

the opposing pair of external conducting plates each comprising a base and a hanging beam extending upwards from the base which has a contact part positioned adjacent to a free end of each of the external conducting plates, and that on the surface of the contact part of each of the external conducting plates, there is a first protruding portion protruding backwards, and that a top width of the external accepting slot is enlarged to more than two times of a thickness of each of the external conducting plates, so that an element for ejection mold is able to be made large enough to maintain a sufficient strength and retain an unanimity of a spacing between the external conducting plates, and that on the surface of the base, there is a second protruding portion protruding backwards by punching, so that a middle part of each of the external conducting plates has only two L shaped surfaces which can be tightly clipped to the respective external accepting slot which width is several times larger than a thickness of each of the external conducting plates, a welded foot being extended downwardly from another end of each of the external conducting plates to the bottom of the dielectric enclosure; and the internal conducting plates and the external conducting plates being made by punching reversely arrayed face to face and connected with two material tapes and connecting strips, the internal and external conducting plates being reversely bent to make a spacing staggering therebetween, so that the material tapes and the connecting strips are more convenient for further treatment, the first and second protruding portions on the internal conducting plates and the first and second protruding portions on the external conducting plates being formed by punching process in the reverse direction with each other for guiding and positioning, and to clip into the accepting slot in the way staggering each other with a spacing, and that the pair of the internal conducting plates and the pair of the external conducting plates are isolated by the inner wall, so that the unanimity of spacings among numerous internal and external conducting plates is retained, the middle parts of the internal and external conducting plates being firmly secured to a lower section of the accepting slot which width is several times larger than the thickness of the internal and external conducting plates, upper portions of the internal and external conducting plates providing the unanimous spacing for inserting the daughter board, so that when it is being drawn out, a uniformly distributed force is exert on a center line of the internal and external conducting plates.

2. A connector for micro channel printed circuit board, as recited in claim 1, wherein at the bottom surface of the dielectric enclosure, a holder mole is provided on which a holder is attached, in which the holder is to be inserted into the guiding hole formed on the mother board, so that the connector is able to be accurately guided to clip into the corresponding position on mother board.

3. A connector for micro channel printed circuit board, as recited in claim 1, wherein a guide wall is extended upwards from front and rear upper ends of the dielectric enclosure, which is used to guide the daughter board into the inserting groove.

4. A connector for micro channel printed circuit board, as recited in claim 3, wherein at the bottom surface of the dielectric enclosure, a holder mole is provided on which a holder is attached, in which the holder is to be inserted into the guiding hole formed on the mother board, so that the connector is able to be accurately guided to clip into the corresponding position on mother board.

5. A connector for micro channel printed circuit board, comprising a daughter board, a dielectric enclosure, at least an internal conducting plate, at least a pair of opposing external conducting plates, and a mother board;

at least a mounting slot being provided on the daughter board, an inserting groove being formed at a center of the dielectric enclosure for accepting part of the daughter board, at least a mounting post being provided in the inserting groove at a position corresponding to the mounting slot, a plurality of accepting slots which are isolated by a plurality of inner walls respectively being arranged in array along two sides of the inserting groove, a rim of each of the inner walls being used to divide the inserting groove, in which at a bottom of each of the opposing rims there is an intermittent post dividing each the accepting slot into two sections on two sides respectively, each of the sections of each the accepting slot including an internal accepting slot, two barriers and an external accepting slot which has a fixing groove provided thereon, wherein a width of the accepting slot is more than twice larger than a thickness of the conducting plate, so that it is possible to array in staggering the pair of internal conducting plates and the pair of the external conducting plates which are all side cross sectional contact type;

the internal conducting plate having a bottom which middle portion is connected together to form a single body configuration, the internal conducting plate including a base, two cantilever beams extending upwards from two sides of the base, and two protruding portions protruding upwards from a middle portion of each of the cantilever beams, a corresponding contact part being positioned adjacent to a free end of each of the cantilever beams of the internal conducting plate, a first protruding portion which is protruded forwards being provided on a surface of each the contact part for allowing the internal conducting plate to be able to move within a fixed range of spacing for assuring not to escape offside from the spacing, the internal conducting plate merely comprising one welded foot which is extended downwardly from the base of the internal conducting plate downwardly to the bottom of the dielectric enclosure, a slot gap cut in L shape is provided between the protruding portion and the cantilever beam, wherein the cut portion is folded forwards to form a second protruding portion with an inclined arc shape, so that the internal conducting plate has a sufficient range for movement, a sharp protrusion being provided for an end surface of each of the cantilever beams and the protruding portion respectively, so that when the internal conducting plate is clipped into the internal accepting slot, the first protruding portion is immediately contacted with an inner wall surface of the internal accepting slot, at the same time, an isolating wall recessing between the two protruding portions which are clipped to the slot gap, therefore the internal conducting plate is firmly positioned to the internal accepting slot;

the opposing pair of external conducting plates each comprising a base and a hanging beam extending upwards from the base which has a contact part positioned adjacent to a free end of each of the external conducting plates, and that on the surface of the contact part of each of the external conducting plates, there is a first protruding portion protruding backwards, and that a top width of the external accepting slot is enlarged to more than two times of a thickness of each of the external conducting plates, so that an element for ejection mold is able to be made large enough to maintain a sufficient strength and retain an unanimity of a spacing between the external conducting plates, and that on the surface of the base, there is a second protruding portion protruding backwards by punching, so that a middle part of each of the external conducting plates has only two L shaped surfaces which can be tightly clipped to the respective external accepting slot which width is several times larger than a thickness of each of the external conducting plates, a welded foot being extended downwardly from another end of each of the external conducting plates to the bottom of the dielectric enclosure; and the internal conducting plate and the external conducting plates being made by punching reversely arrayed face to face and connected with two material tapes and connecting strips, the internal and external conducting plates being reversely bent to make a spacing staggering therebetween, so that the material tapes and the connecting strips are more convenient for further treatment, the first and second protruding portions on the internal conducting plate and the first and second protruding portions on the external conducting plates being formed by punching process in the reverse direction with each other for guiding and positioning, and to clip into the accepting slot in the way staggering each other with a spacing, and that the internal conducting plate and the pair of the external conducting plates are isolated by the inner wall, so that the unanimity of spacings among numerous internal and external conducting plates is retained, the middle parts of the internal and external conducting plates being firmly secured to a lower section of the accepting slot which width is several times larger than the thickness of the internal and external conducting plates, upper portions of the internal and external conducting plates providing the unanimous spacing for inserting the daughter board, so that when it is being drawn out, a uniformly distributed force is exert on a center line of the internal and external conducting plates.

6. A connector for micro channel printed circuit board, as recited in claim 5, wherein at the bottom surface of the dielectric enclosure, a holder mole is provided on which a holder is attached, in which the holder is to be inserted into the guiding hole formed on the mother board, so that the connector is able to be accurately guided to clip into the corresponding position on mother board.

7. A connector for micro channel printed circuit board, as recited in claim 5, wherein a guide wall is extended upwards from front and rear upper ends of the dielectric enclosure, which is used to guide the daughter board into the inserting groove.

8. A connector for micro channel printed circuit board, as recited in claim 7, wherein at the bottom surface of the dielectric enclosure, a holder mole is provided on which a holder is attached, in which the holder is to be inserted into the guiding hole formed on the mother board, so that the connector is able to be accurately guided to clip into the corresponding position on mother board.

9. A connector for micro channel printed circuit board, comprising a daughter board, a dielectric enclosure, at least a pair of opposing internal conducting plates, at least a pair of opposing external conducting plates, and a mother board; wherein an inserting groove is provided at a center of the dielectric enclosure for accepting part of the daughter board, a plurality of accepting slots being in array at both sides of the inserting groove, each of the accepting slots being isolated by an inner wall and outside of which a mounting slot for conducting plate is provided, a rim of each the inner wall being used to divide the inserting groove, at a bottom of the rims, an intermittent post being provided for separating the rims, an internal accepting slot and an external accepting slot of the accepting slot being provided, the mounting slots being provided for each of the accepting slots for arranging the pair of opposing internal conducting plates and the pair of external conducting plates;

each of the internal conducting plates comprises a hanging beam, a bent part extending upwards from the hanging beam and a supporting part extending downwards from the hanging beam, a corresponding contact part being formed adjacent to the bent part of each of the internal conducting plates, wherein part of the conducting plates are formed into a tilted thin plate through continuous pressing and forging, the internal and external conducting plates being pressed in reverse direction with one another to form the tilted thin plates, so that an unanimity of spacings among numerous of the adjacent internal and external conducting plates is maintained, and that a density and elasticity of the tilted thin plates are so high that tightness of eccentric contact between the internal and external conducting plates is able to be obtained to improve the quality of contact, jutting ears being provided between the hanging beam and the supporting part of the internal conducting plates so as to hold the internal conducting plates at an exact place thereof stably and to maintain the spacings unanimous with respect to the external conducting plates which is convenient for free moving and not to escape from the spacings extended from other ends of the internal conducting plates, each of the internal conducting plates further comprising a welded foot extended downwardly from another end of each of the internal conducting plates to a bottom of the dielectric enclosure; and each of the opposing external conducting plates comprises a hanging beam and a tilted part which is extended upwards from the hanging beam, a corresponding contact part being formed adjacent to a free end of each of the contacting plates each of which also comprises a welded foot extending from another end of each of the external conducting plates to the bottom of the dielectric enclosure.

* * * * *